United States Patent [19]

Hurd

[11] 4,133,061

[45] Jan. 9, 1979

[54] EASILY DISASSEMBLED HINGE ASSEMBLY

[76] Inventor: Everett C. Hurd, 12871 Barrett La., Santa Ana, Calif. 92705

[21] Appl. No.: 802,217

[22] Filed: May 31, 1977

[51] Int. Cl.[2] ..... A47K 13/12

[52] U.S. Cl. ..... 4/236; 4/239; 4/240; 16/128 B

[58] Field of Search ..... 4/236, 240, 239, 237; 16/128 B

[56] References Cited

U.S. PATENT DOCUMENTS

| | | | |
|---|---|---|---|
| 588,224 | 8/1897 | Gavin et al. | 4/236 |
| 2,221,991 | 11/1940 | Myers et al. | 4/240 |
| 2,333,732 | 11/1943 | Morris | 4/240 |
| 3,038,173 | 6/1962 | Turek et al. | 4/236 |
| 3,210,777 | 10/1965 | Katoh | 4/239 |
| 3,334,361 | 8/1967 | Watson | 4/236 |
| 3,471,874 | 10/1969 | Dixon | 4/240 |

*Primary Examiner*—Richard E. Aegerter
*Assistant Examiner*—L. Footland

[57] ABSTRACT

A hinge assembly for pivotally coupling two members, each of which can be removed from the total assembly without removal of any component part(s) of the hinge assembly. A pair of swivel upright ball pins are locked in place on the stationary base to provide mounting stanchions for the pivotal members having opposing concave, spherical sockets wherein the ball is held. When used, for example, in conjunction with a toilet seat assembly, the toilet seat can be quickly removed from the toilet bowl for cleaning, replacement, or substitution with a child's version of toilet seat.

3 Claims, 5 Drawing Figures

FIG. 2.
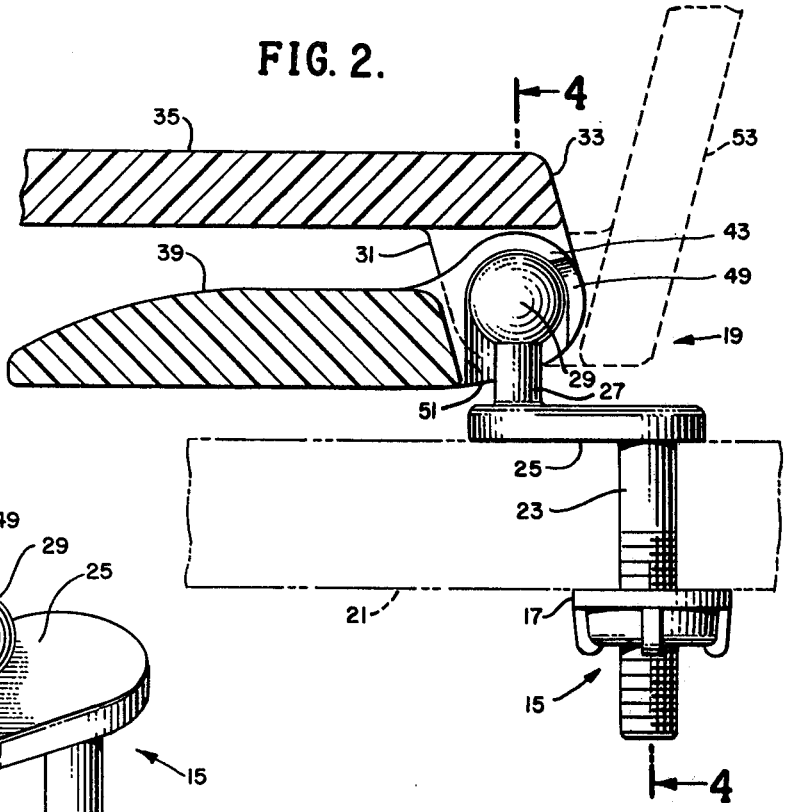
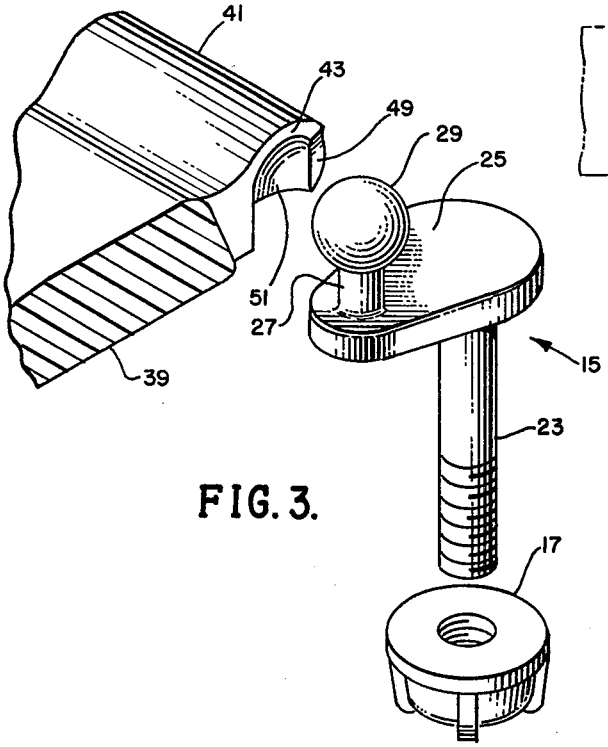
FIG. 3.
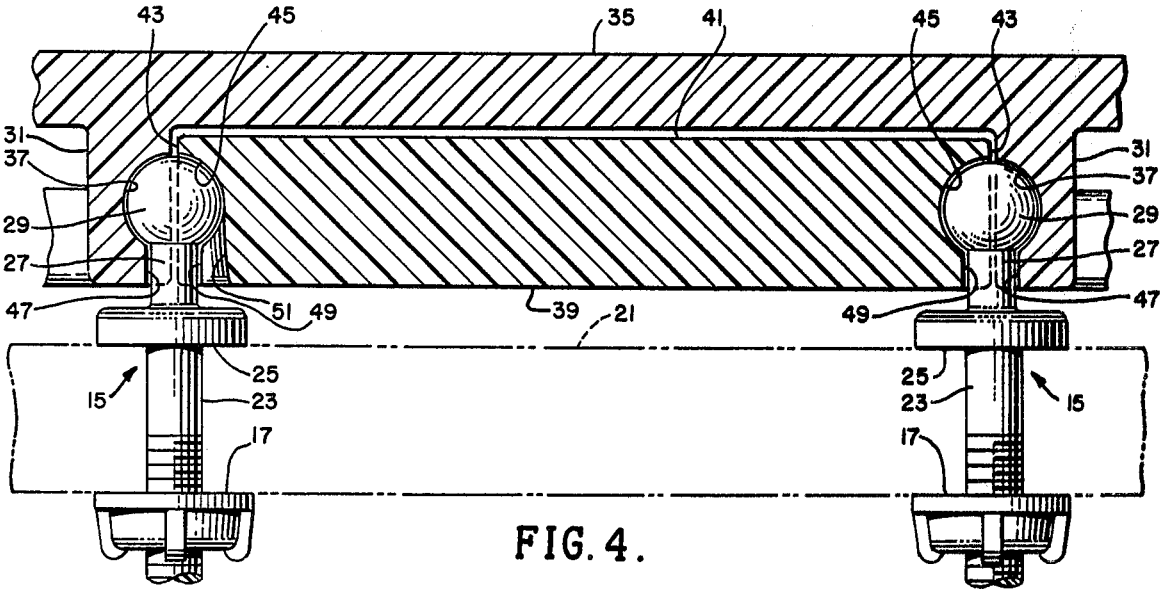
FIG. 4.

EASILY DISASSEMBLED HINGE ASSEMBLY

BACKGROUND OF THE INVENTION

This invention relates to hinges used for pivotally coupling a plurality of component parts, such as toilet seat components, comprising a pivotal cover lid and pivotal toilet seat ring.

In the conventional toilet seat the cover lid and seat ring are hinged together and semi-permanently bolted to the toilet bowl unit. As a result, these members cannot be routinely removed from the toilet bowl unit for cleaning and sanitizing.

In addition, the prior art hinges utilized for the purpose of mounting a toilet seat assembly to a toilet bowl comprise many individual parts, some of which are more prone to deterioration or breakage due to water corrosion or continual usage than others. Replacement of the defective individual parts is impossible due to the fact that the hinge assembly is sold as a complete unit. The same condition exists in the replacement of the toilet seat ring which usually deteriorates from normal use before any other component of the seat assembly. In this case its replacement is impossible because the lid and seat must be purchased as a complete assembled unit.

Another disadvantage prevelent in the current state of art is the need in a majority of households to convert the conventional adult toilet bowl to a child's facility by the cumbersome attachment of a small adaptive seat or device to accommodate small children who are in the process of toilet training. Such devices are difficult to store conveniently when not in use due to their size and need for immediate accessibility.

SUMMARY OF THE INVENTION

The preferred embodiment of the present invention disclosed herein comprises a pair of upright ball stanchions, whereon a toilet set lid and a toilet seat ring are pivotally mounted. The toilet seat ring can be easily removed from said assembly by raising the cover lid to its upright position and tilting the seat ring from its reclining position. The cover lid can also be disengaged from the ball stanchions. Thus, each separate member of the assembly can be easily removed to permit washing, sanitizing or replacement without disassembling the hinge components.

In addition, the conventional adult toilet seat ring can be quickly substituted with a child's toilet seat ring when the occasion requires such facilities, thus eliminating the need for a separate child's toilet-training chair.

It must be understood that the utilization of the hinge assembly herein described is not limited to only its use in conjunction with a toilet seat assembly but may be adapted to the pivotal mounting of other devices, lids, covers, etc.

These and other advantages of the present invention are best understood through a reference to the drawings, in which:

FIG. 2 is a partial sectional view of a closed toilet seat assembly taken at the hinge assembly;

FIG. 3 is an exploded perspective view of a singular hinge stanchion with the respective concave, spherical socket in the toilet seat ring;

FIG. 4 is a partial sectional view of the hinge assembly taken along lines 4—4 of FIG. 2.

DETAILED DESCRIPTION OF THE PREFERRED EMBODIMENT

Figure 1:
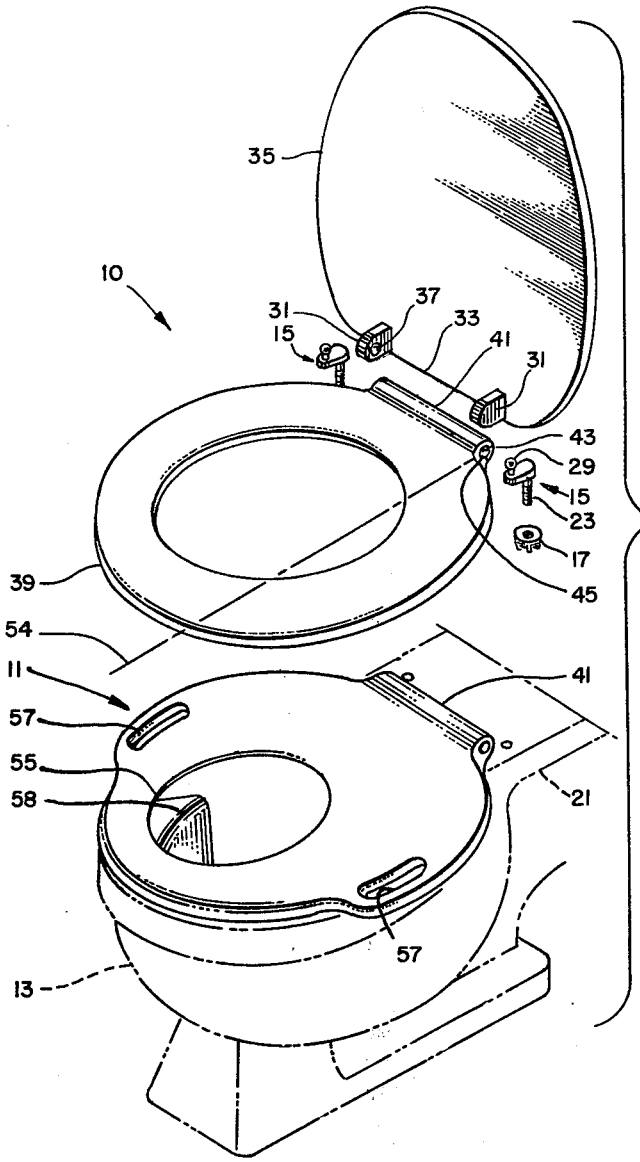
FIG. 1 is an exploded perspective view showing the individual components of the toilet seat assembly.

Referring initially to FIG. 1, an improved adult's toilet seat assembly 10 with a supplementary child's version of a toilet seat ring 11 are shown; the latter being positioned on a conventional toilet bowl 13 (shown in phantom lines). A pair of hinge stanchions 15 with lock nuts 17 are shown in a disengaged position.

Referring now to FIGS. 2, 3 and 4, the preferred embodiment of the hinge assembly 19 will be described in detail. Primarily, the hinge assembly 19 comprises a pair of hinge stanchions 15 which are attached to the rear toilet bowl flange 21 by means of downwardly extending integral bolts 23 and plastic locknuts 17. A crankarm 25 integrally joins the bolt 23 with an upright cylindrical pin or stanchion 27. The upright stanchion 27 terminates in a ball 29. Two depending ears 31 protruding at approximately 90° from the rear circumferential edge 33 of the top cover lid 35 engage the ball portions 29 of the stanchions 15 by means of concave, spherical indentations or recesses 37 on the inward sides of said ears 31. An accurate positioning or nesting of the balls 29 within the recesses 37 is easily accomplished by means of the swiveling action provided by the crankarm portion of the hinge stanchions 15. Alternatively, either the upright ball stanchions or the ears 31 or both may be formed of a plastic material which permits one or both of these members to be flexed so that the lid can be simply removed and re-engaged with the balls 29 for routine cleaning and the like.

The toilet seat ring 39 has an elongate cylindrical protrusion 41 integrally molded at the rear of its circumferential configuration. The opposite ends 43 of the protrusion 41 are formed with concave, spherical indentations 45. The length of the cylindrical protrusion 41 on the seat ring 39 is equal to the inner space between the ears 31 on the lid 35. A slight clearance is provided between all of the mating portions, 31, 41 and 29, as best shown in FIG. 4, to enable the lid 35 and seat 39 to pivot freely on the balls 29 of the hinge stanchions 15.

The alignment between the mating pivotal members of the total seat assembly is inherent in its molded configuration, however, the seat assembly may be shifted in its position on the rim of the toilet bowl 13 due to the swivel action permitted by the pair of crankarms 25. To clear the cylindrical pin 27, a recess 47 (shown in FIG. 4) is provided around approximately one-fourth of the surface surrounding the identations 37 in each of the ears 31 of the lid 35. A similar recess 49 is provided on each end 43 of the protrusion 41 of the seat 39. Since the pivoting movement of both toilet seat components 35 and 39 is limited to approximately 90°, the respective recesses 47 and 49 are confined within this quadrant of movement.

To enable the toilet seat 39 to be positioned in place between the balls 29 of the hinge stanchions 15, one of the spherical indentations 45 incorporates a relieved portion in the form of a curved semi-circular groove 51 as best shown in FIG. 4. In assembling of the seat ring 39 between the stanchions 15, the seat is tilted at an angle about an imaginary axis shown generally at 54 in FIG. 1, which axis is generally orthogonal to the seat pivot axis. The right spherical indentations 45 (as seen in FIG. 4) of the protrusion 41 is engaged in its corresponding ball 29 first and thereafter the seat is tilted about the axis 54 to a normal horizontal position with the left indentation 45 having the semi-circular groove 51 positioned in place on the ball 29 of the left stanchion 15. As shown, the curved groove 51 enables the seat ring 39 to swing in place without interference. During the operation of disengagement or engagement of said seat ring 39, the cover lid 35 is lifted to its upright generally vertical position 53 as shown by dotted lines in FIG. 2.

As a result, the seat ring may be easily removed from the toilet bowl for routine cleaning. However, the ring remains pivotally mounted to the hinge stanchions at all times during normal operation. Although removal is very quick and simple, such removal is only possible when the cover lid is in its upright position and the seat is tilted about the axis 54 generally orthogonal to its normal pivot axis.

Similarly, the toilet seat ring 39 may be removed from the toilet bowl 13 and replaced with the child's version 11 as depicted in FIG. 1. The child's version of toilet seat ring 11 comprises a molded ring with a similar hinge connecting protrusion 41 as the conventional seat 39. A smaller hole 55 to accommodate the smaller bodily proportions of the child is provided in said seat 11. Integral hand grips 57 molded at diametrically opposite locations of the seat ring 11 are provided to enable the child to safely mount the seat. The hand grips 57 also facilitate the rapid changeover to the conventional seat and its storage by hanging. A removable, snap-on deflector 58 is provided for little boys' use of the child's toilet seat 11.

Figure 5:
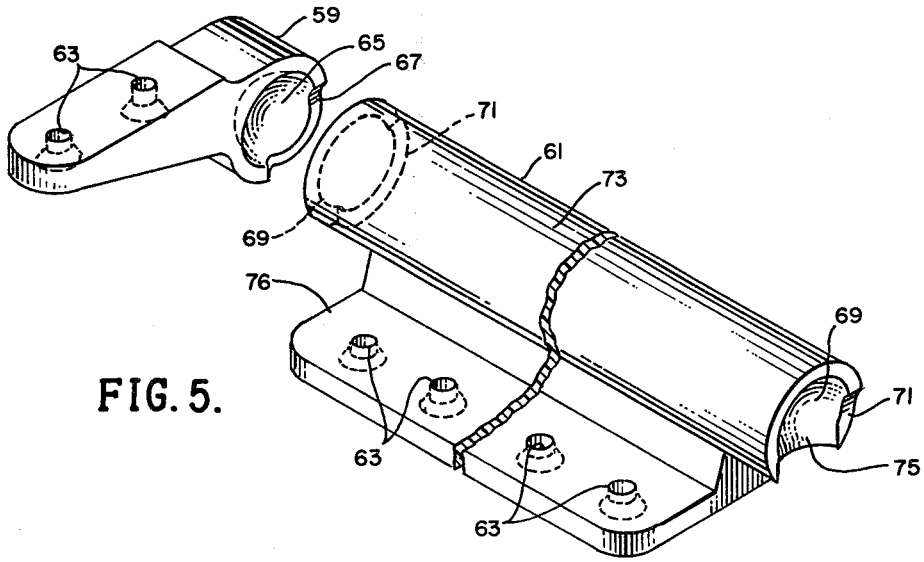
FIG. 5 is an exploded perspective view of an alternate embodiment of the hinge assembly used as a replacement unit.

Referring now to FIG. 5, alternate embodiment of the hinge assembly is shown wherein separate pivotal cover lid brackets 59 and toilet seat ring connector 61 are molded as individual parts. The screw holes 63 permit the substitution of the hinge assembly of this invention upon the conventional toilet seat unit or the addition of this assembly to padded or decorator-type seats made of carved hardwood or other materials. The individual members 59, 61 are so positioned upon the lid and seat ring respectively to encompass the balls 29 of a pair of upright hinge stanchions 15 in a similar manner as previously described in the preferred embodiment. The brackets 59 are provided with concave, spherical indentations 65 on both sides thus eliminating the need for individual left and right units. The quadrant recess 67 provides pivotal clearance for the pin 27 of the stationary stanchion 15. The connector 61 has identical spherical cavities 69 and quadrant recesses 71 at both extremities of the elingate cylindrical position 73. In addition to the quadrant recess 71 on the right end of the connector 61 as shown in FIG. 5, a curved semi-circular groove 75, similar to groove 51 of the preferred embodiment, connects to the spherical indentations 69. Thus, the connector 61 can swing into place without interference between the balls 29 of the stanchions 15. The base 76 of the connector 61 is attached to the underside of a conventional toilet seat ring (not shown) by means of screws inserted through the screw holes 63.

All hinge components herein described are advantageously molded from a high tensile strength plastic, teflon, or other suitable material which is impervious to rust, corrosion and discoloration.

In summary, there has been described an improved, mechanically simplified hinge assembly for pivotally coupling one or two mating parts, such as the lid and seat of a toilet seat assembly, and permitting the disengagement of the mating members from the hinge assembly without disassembly of said hinge. Thus, the hinge assembly described in the foregoing specification permits the quick removal of the toilet seat for reasons of cleaning, replacement or substitution with the child's version of a toilet training seat. The molded members of the toilet seat assembly have integral mating protrusions which encompass a pair of hinge stanchions, thus limiting the number of separate component parts of the assembly to a total of four, two of which are the stanchions.

The alternate embodiment herein described permits the replacement of existing conventional hinge assemblies with a replacement screw-on kit of the preferred embodiment.

What is claimed is:

1. A mechanically simplified hinge assembly for a toilet seat and cover comprising:

stationary hinge stanchion means having spherical ball extremities for pivotally supporting the toilet seat and cover;

depending spaced ears protruding from said cover and having juxtaposed concave, spherical indentations to accommodate and accurately position with a slight clearance a portion of said spherical ball extremities; and means on said toilet seat for both pivotally mounting said seat to said spherical ball extremities and providing quick and simple disengagement of said toilet seat comprising (i) oppositely facing concave, spherical indentations for accommodating other portions of said spherical ball extremities, and (ii) a relief groove having an access orthogonal to the plane of said seat and joining one of said concave, spherical indentations so that said seat is removed by merely tilting it about an axis in the plane of said seat and generally orthogonal to the pivot axis of said seat.

2. The hinge assembly as defined in claim 1 wherein toilet seat may not be disengaged from said hinge stanchions unless said cover is in its upright, generally vertical position.

3. The hinge assembly as defined in claim 1 wherein a childs training seat is also provided with substantially the same means as said toilet seat for pivotally mounting said training seat to said spherical ball extremities and providing quick and simple disengagement thereof so that said toilet seat may be quickly and simply replaced by said childs training seat.

* * * * *